US005650120A

United States Patent [19]

Morando

[11] Patent Number: 5,650,120

[45] Date of Patent: Jul. 22, 1997

[54] BUBBLE-OPERATED RECIRCULATING PUMP FOR METAL BATH

[75] Inventor: Jorge A. Morando, Grosse Ile, Mich.

[73] Assignee: Alphatech, Inc., Trenton, Mich.

[21] Appl. No.: 560,661

[22] Filed: Nov. 20, 1995

Related U.S. Application Data

[63] Continuation-in-part of Ser. No. 489,332, Jun. 12, 1995, abandoned.

[51] Int. Cl.[6] ..... C21C 5/42

[52] U.S. Cl. ..... 266/233; 266/239; 222/603

[58] Field of Search ..... 75/705, 708, 509; 222/590, 591, 603; 266/200, 233, 239

[56] References Cited

U.S. PATENT DOCUMENTS 5,203,910 4/1993 Areaux et al. ..... 75/708

5,395,094 3/1995 Areaux ..... 266/233

5,397,378 3/1995 Areaux ..... 75/708

OTHER PUBLICATIONS

Molten Aluminum Pumping and Hydrogen Removal by Gas Lift: Water Model Studies and Preliminary Molten Aluminum Experience Authors: Frede Frisvold, Thorvald A. Engh. Didrik S. Voss Dec. 1993.

Liquid Gas Two Phase Flow Theory of Jet Pump Author: Lu Hongqi Apr. 1983.

*Primary Examiner*—Scott Kastler

*Attorney, Agent, or Firm*—Charles W. Chandler

[57] ABSTRACT

A bubble-operated pump for recirculating molten metal in a bath of such metal.

29 Claims, 3 Drawing Sheets

BUBBLE-OPERATED RECIRCULATING PUMP FOR METAL BATH

CROSS-REFERENCE TO RELATED APPLICATIONS

This is an continuation-in-part of application Ser. No. 08/489,332 filed Jun. 12, 1995 for "Bubble Apparatus for Removing and Diluting Dross in a Steel Treating Bath," now abandoned.

BACKGROUND OF THE INVENTION

This invention is related to a bubble-operated pump for recirculating liquid metal in a bath of molten metal. It is desirable to circulate the metal in a bath of molten metal, such as of aluminum, used to coat steel and the like. The high temperatures and the chemical and physical natures of the metal make it difficult to provide a long-lived mechanical pump.

Several versions of a bubble-operated pump for such purpose are illustrated in U.S. Pat. No. 5,203,910 which was issued Apr. 20, 1993 to Larry D. Areaux and Brian Klenoski for "Molten Metal Conveying Means and Method of Conveying Molten Metal from One Place to Another in a Metal-Melting Furnace." The Areaux, et al. patent shows a pump having an inclined conduit for drawing metal from the bottom of the pot and passing it upwardly to a discharge point below the metal line. The metal flow is induced by introducing nitrogen through a gas feed pipe. Areaux preferred that the pipe be made of metal clad with ceramic, or more advantageously a graphite clad with ceramic. Such pipe is difficult to make and has a relatively short life.

Pipe metal will dissolve in the molten metal, and the graphite will burn. In addition, the difference in the coefficients of expansion between the ceramic and the graphite will make both approaches fail following immersion in the bath. The inclined conduit design, in addition, is not realistic since the support and gas transmit must occur at a single point.

Tests conducted on the Areaux design shown in FIGS. 15 and 16, (the only configuration that could actually be fabricated) demonstrated that separation of the different materials generated gas leakage capable of completely eroding the pump graphite components in a matter of hours.

The sharp transition required at the top of the inclined tube created cavitation. The gas pressure and temperature in this area overcame the impact resistance of the ceramic, causing it to break.

The Areaux design must use cylindrical tubes, not an elliptically shaped tube, in order to warrant some sort of seal between the ceramic and graphite or steel components. To increase the pump flow, his design requires a plurality of cylindrical inclined tubes manifolded by a graphite, steel or refractory housing with the obvious manufacturing and operational complications.

SUMMARY OF THE INVENTION

The broad purpose of the present invention is to provide a simpler and improved bubble-operated, pump for recirculating molten metal. The preferred embodiment of the invention provides a somewhat "S" shaped metal pumping conduit. Nitrogen is introduced into the pump through a pair of hollow spaced vertical legs, disposed on opposite sides of the pumping conduit. A hollow horizontal cross member connects the bottom of the vertical legs to the underside of the pumping conduit. The gas is introduced near the lowest point of the pumping conduit for inducing metal flow. The two gas-delivery vertical legs have their lower ends adapted to engage the bottom of the pot so that the pump structure is self-supporting. The two vertical legs provide an efficient means for adjusting the rate of gas flow as well as providing a conduit for passing a substantial amount of gas to the pumping conduit.

My design can increase the pump flow by utilizing an elliptical cross section tube and increasing the number of nitrogen gas orifices thus increasing the pump flow without jeopardizing its simplicity. The preferred design will pump twice as much as Areaux single design with half the component parts using a double orifice configuration. Areaux's inclined tube configuration, requires additional components to deliver nitrogen to the pumping tubes lowest point. The gas head pressure creates a momentum forcing the pump to rotate and vibrate cracking the holding-sealing elements and generating additional detrimental leaks.

In the proposed design the nitrogen is released in the center of the vertical section of the "S" eliminating all momentums and assuring a vibration free pump.

In another embodiment of the invention the pair of gas-delivering vertical hollow legs are mounted on the upper side of the pumping conduit. The lower ends of the two legs are connected to a hollow collar that passes around the pumping conduit to deliver gas through an opening in the bottom of the pumping conduit. This embodiment also provides a self-supporting structure with substantial gas-delivering conduits.

Each component of the two pumps can be cast from a ceramic composition and joined together with a slurry of the ceramic material, prior to final firing of the entire assembly.

Still further objects and advantages of the invention will become readily apparent to those skilled in the art to which the invention pertains upon reference to the following detailed description.

BRIEF DESCRIPTION OF THE DRAWINGS

The description refers to the accompanying drawings, in which like reference characters refer to like parts throughout the several views and in which.

DESCRIPTION OF THE PREFERRED EMBODIMENT

Figure 3:
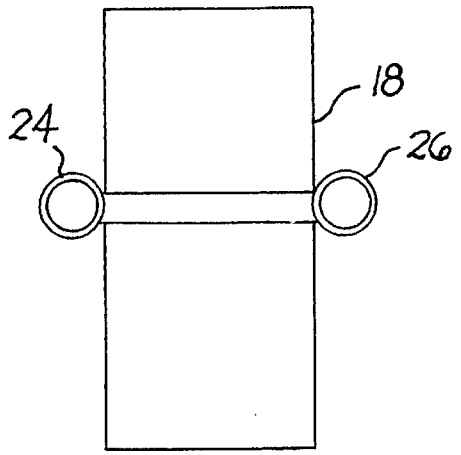
FIG. 3 is a plan view of the pump illustrated in FIG. 1.

Referring to the drawings, a preferred bubble-operated pump 10 is mounted on the bottom of a pot 12 of molten metal 14 having a metal line 16. The pump includes a generally "S" shaped pumping conduit 18 having an inlet opening 20 adjacent the bottom of the pot, and an outlet opening 22. Outlet opening 22 is supported a few inches below metal line 16.

The pump also includes a pair of vertical gas-delivering legs 24 and 26.

The internal diameter of legs 24 and 26 is about 1¾".

All components of the pump immersed in the molten metal are preferably manufactured from a ceramic material that is resistant to the molten metals i.e. RBSN-AL 25, available from ALPHATECH, Inc. of Trenton, Mich., that has proved to be an extremely resistant to molten aluminum attack at temperatures up to 1600° F. In a zinc galvanizing bath, the pump may be manufactured from stainless steel material, or A T-103 or A T-103-A a metallic super alloy material also available from ALPHATECH, Inc. and specially formulated for resistance to zinc at temperatures up to 1400° F.

The internal diameter of the pumping conduit depends upon the amount of molten metal expected to be circulated. For most pots, a tube diameter of 3½" should be sufficient.

Inlet opening 20 of the pumping conduit is formed in a plane disposed at an angle of 45°–60° with respect to vertical legs 24 and 26. The pumping conduit has a substantially uniform cross section throughout its length from the inlet opening to the outlet opening. Note that the midsection of the pumping conduit is linear and vertical, curving upwardly toward outlet opening 22, and downwardly toward inlet opening 20. The overall height depends on the particular depth of the furnace, but for illustrative purposes, is about 15". Note that the internal cross section has a somewhat elliptical flattened configuration, preferably with a width A of 6½" and an internal height B of 3⅛" (FIG. 1).

Hollow legs 24 and 26 have their lower closed ends 32 horizontally spaced and adapted to engage the bottom of the pot. The bottom side 34 of the pumping conduit is also adapted to engage the bottom of the pot and cooperates with legs 24 and 26 to provide a self-supporting configuration, engaging the pot and cooperates in three locations.

Figure 4:
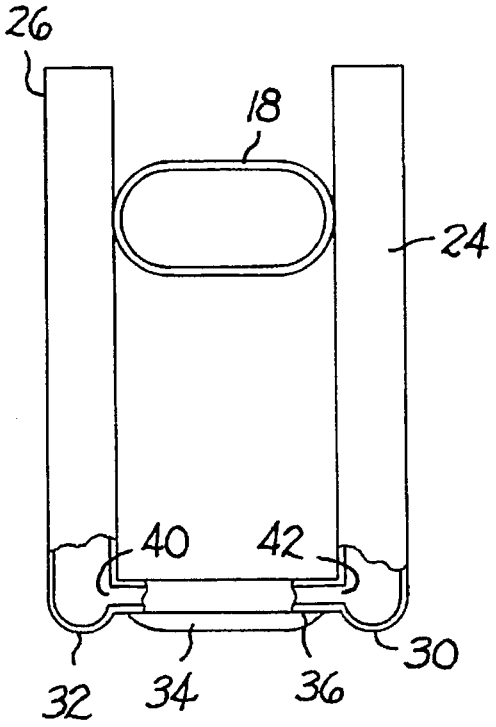
FIG. 4 is a view as seen from the right side of FIG. 2.

Referring to FIG. 4, a hollow cross member 36 has its ends rigidly and fluidly connected to openings 40 and 42 in legs 26 and 24, respectively. Cross member 36 is, in turn, in fluid communication with the pumping conduit through opening means 44.

Figure 1:
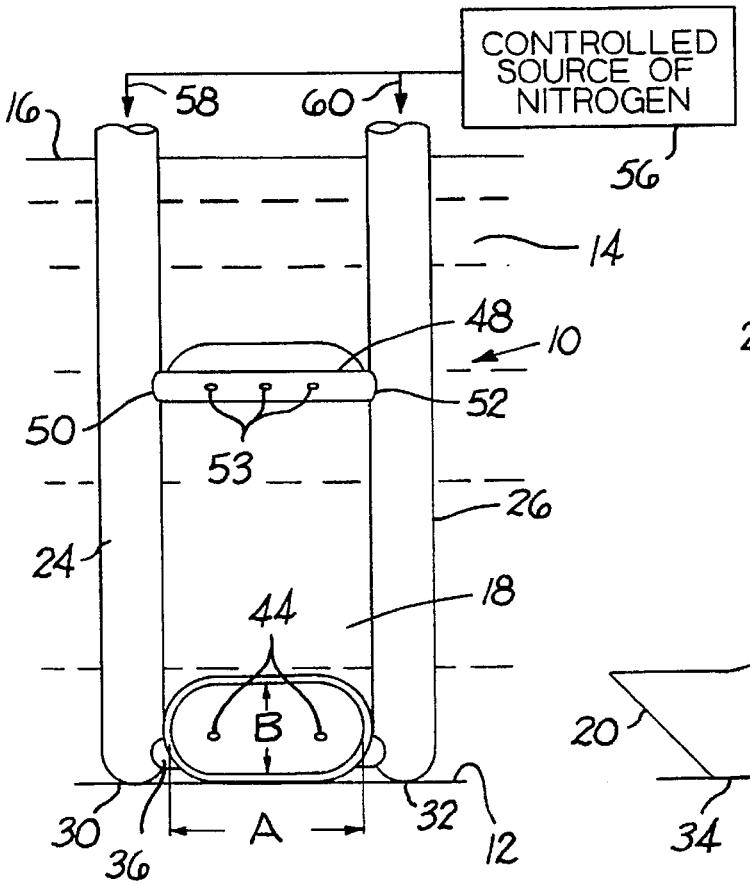
FIG. 1 is an elevational view of a bubble-operated pump illustrating the preferred embodiment of the invention.
Figure 2:
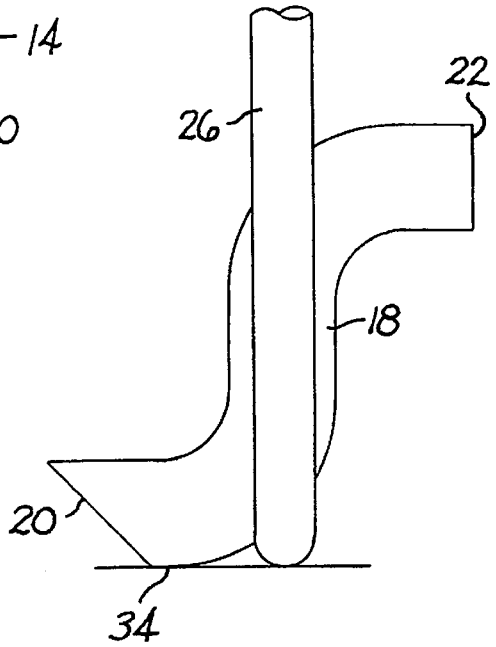
FIG. 2 is a view as seen from the right side of FIG. 1.
Figure 5:
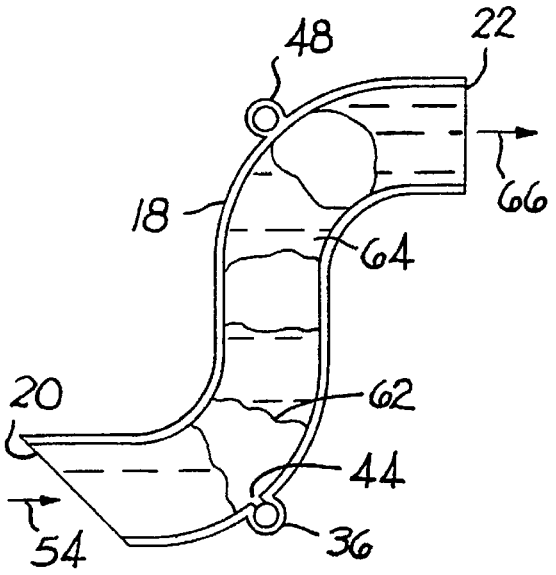
FIG. 5 is an elevational sectional view of the pump.

Referring to FIGS. 1 and 5, an upper horizontal cross member 48 has its ends attached to hollow legs 24 and 26 at 50 and 52, respectively. The ends of cross member 48 are closed and provide a reinforcing structure for the two vertical legs. Cross member 48 is also attached to pumping conduit 18. Cross member 48 has a diameter of about 1¼". Vents 53 permit the passage of air from the interim of the cross member when the pump is immersed in the molten metal.

Legs 24 and 26 are attached to the opposite sides of the pumping conduit, and joined by using a slurry of a ceramic material before the pump is fired in a kiln.

In operation, referring to FIGS. 1 and 5, the pump is immersed in the pot and the molten metal is admitted through inlet opening 20 in the direction of arrow 54. Nitrogen from a source 56 is introduced through either or both legs 24 and 26 in the direction of arrows 58 and 60, respectively. Nitrogen is produced either continuously or intermittently down through the legs, into cross member 36 and through opening means 44 to produce a series of spaced bubbles 62 because of surface tension, generally, in accordance with the procedure described in my co-pending patent application. The rising bubbles induce a flow of molten metal upwardly through the pumping conduit upwardly through the pumping conduit creating a suction at inlet opening 20. The bubbles rise with the molten aluminum. The rising bubbles entrap sections of molten aluminum 64 and carry them upwardly through outlet 22 in the direction of arrow 66.

By applying an intermittent flow of gas, the gas flow rate can be optimized by adjusting the frequency of the bubbles formation and expansion rate to match the particular application. The pump apparatus has no moving mechanical parts exposed to the molten metal.

The capacity of the pump can be increased by increasing the internal width of the pumping conduit, but retaining the same internal height. The number of opening means 44 can be appropriately increased. This increases the volume of metal that can be pumped without reducing the pumping height that the bubbles travel from the molten metal inlet opening to the molten metal outlet opening.

Figure 7:
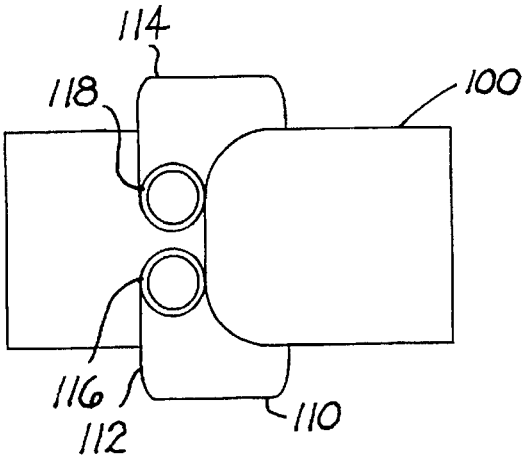
FIG. 7 is a plan view of the pump of FIG. 6.
Figure 6:
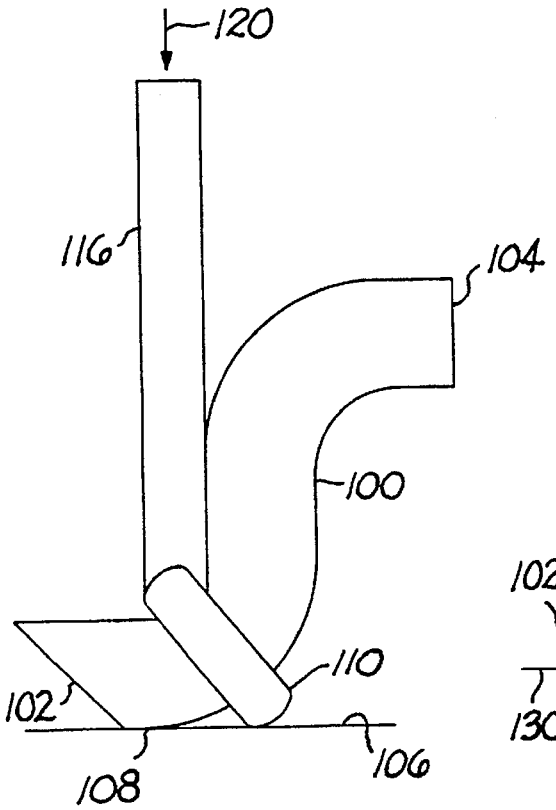
FIG. 6 is illustrates another embodiment of the invention.
Figure 8:
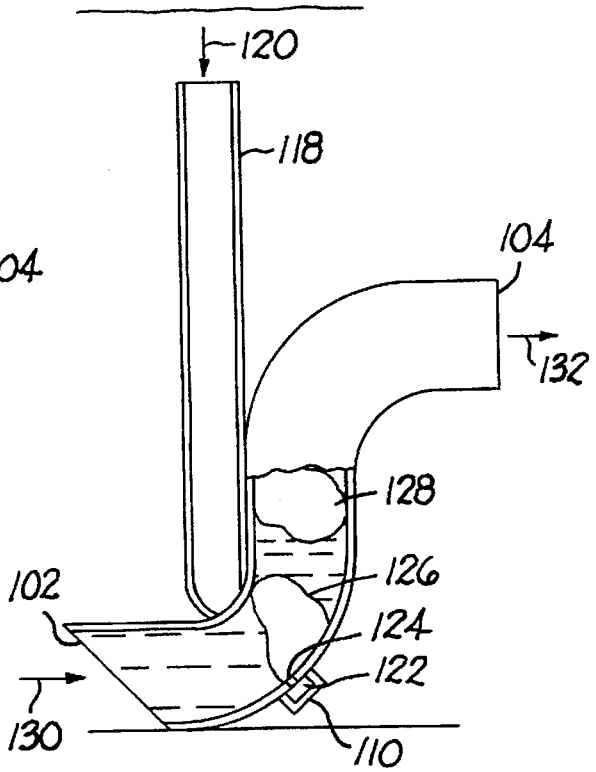
FIG. 8 is a partially sectional view of the pump of FIG. 6.

FIGS. 6–8 illustrate another embodiment of the invention including main pumping conduit 100 which is identical in shape to pumping conduit 18. Conduit 100 has a bottom inlet opening 102 and a top outlet opening 104. The lower end of pumping conduit 100 engages the bottom of pot 106 at 108.

A hollow collar 110 having an internal diameter of 1½" is wrapped around the pumping conduit and has its ends 112 and 114 attached to the lower ends of a pair of hollow gas-delivering legs 116 and 118, respectfully. Hollow legs 116 and 118 have the same diameter as legs 24 and 26 and are adapted to receive an inert gas such as nitrogen in the direction of arrow 120. The lower ends of legs 116 and 118 are fluidly connected to an internal passage 122 in collar 110. Collar 110 has an internal diameter of about 1½". The lower portion of the collar has a somewhat squared configuration as can be seen in FIG. 7. The pumping conduit and the collar form a self-supporting, removable pumping structure in the bottom of the pot. Passage 122 is, in turn, fluidly connected to opening means 124 in the wall of the pumping conduit.

The nitrogen gas passes downwardly into the two vertical gas-delivering legs 116 and 118, into the hollow collar and up into the pumping conduit through opening means 124, forming a series of spaced bubbles such as illustrated at 126 and 128. The bubbles induce a flow of molten metal through inlet opening 102 in the direction of arrow 130. The bubbles raise sections of the liquid metal upwardly and discharge them through outlet 104 in the direction of arrow 132.

This embodiment of the invention may also be formed entirely of hollow ceramic components in a monolithic structure and is preferably formed of the same ceramic disclosed with reference to the embodiment of FIGS. 1–5.

Having described my invention, I claim:

1. In a metal treating apparatus having a pot for holding a bath of molten metal, bubble-operated apparatus for circulating the molten metal in the bath, comprising:

a pumping conduit having a molten metal inlet opening disposed beneath the metal line in the bath for receiving molten metal therein;

the pumping conduit having a molten metal outlet opening for discharging molten metal received in the inlet opening, to a location beneath the metal line of the bath and above the inlet opening;

the pumping conduit having a gas-receiving opening below the molten metal outlet opening and above the molten metal receiving inlet opening;

the pumping conduit being suited for mounting on the bottom of the pot;

a first upright gas delivery conduit disposed on a first side of a pumping conduit, the first upright gas delivery conduit having a lower end suited for mounting on the bottom of the pot;

a second upright gas delivery conduit disposed on the opposite side of the pumping conduit, the second upright gas delivery conduit having a lower end suited for mounting on the bottom of the pot;

whereby the pumping conduit and the first and second upright gas delivery conduits form a self-supporting structure on the bottom of the pot;

a lower conduit means connecting at least one of the first and second upright gas delivery conduits to the gas-receiving opening in the pumping conduit; and means for delivering a gas to said at least one of the upright gas-delivering conduits to the gas-receiving opening in the pumping conduit such that the gas rises in the pumping conduit to induce a flow of molten metal from the molten metal inlet opening towards the molten metal outlet opening.

2. A bubble-operated apparatus as defined in claim 1, in which the lower conduit means comprises a horizontal conduit disposed beneath the pumping conduit and attached thereto, the horizontal conduit having a first end fluidly connected to the first upright gas delivery conduit, and a second end fluidly connected to the second gas delivery conduit.

3. A bubble-operated apparatus as defined in claim 2, including an upper reinforcing member having its ends attached to the first and second upright conduits, respectively.

4. A bubble-operated apparatus as defined in claim 3, in which the upper reinforcing member is a horizontal conduit having its ends connected to the first and second gas delivery conduits, the horizontal conduit having vent opening means.

5. A bubble-operated apparatus as defined in claim 1, in which the pumping conduit has a generally "S" shaped configuration.

6. A bubble-operated apparatus as defined in claim 5, in which the pumping conduit has a bottom inlet opening for receiving a generally horizontal flow of molten metal, a vertical midsection, and a top outlet opening for discharging a generally horizontal flow of molten metal.

7. A bubble-operated apparatus as defined in claim 1, including means for delivering nitrogen to the upright gas delivery conduits.

8. A bubble-operated apparatus as defined in claim 1, including means for introducing a gas intermittently to the pumping conduit to form a series of spaced, rising bubbles which entrap and raise sections of molten metal from the molten metal inlet opening.

9. A bubble-operated apparatus as defined in claim 1, including means for introducing a gas continuously to the pumping conduit to form a series of spaced rising bubbles which entrap and raise sections of molten metal from the molten metal inlet opening.

10. A bubble-operated apparatus as defined in claim 1, and in which the pumping conduit and the first and second upright conduits are formed of a ceramic.

11. A bubble-operated apparatus as defined in claim 1, in which the pumping conduit has an elliptical cross-section.

12. In a metal treating apparatus having a pot for holding a bath of molten metal, bubble-operated apparatus for circulating the molten metal in the pot comprising:

a pumping conduit having a molten metal inlet opening disposed beneath the metal line in the bath for receiving molten metal therein;

the pumping conduit having a molten metal outlet opening for discharging molten metal received in the inlet opening, to a location beneath the metal line of the bath and above the inlet opening;

the pumping conduit having a gas-receiving opening below the molten metal outlet opening and above the molten metal inlet opening;

an upright gas delivery conduit having a lower end disposed adjacent the pumping conduit;

a hollow collar at least partially encirculating the pumping conduit and fluidly connected to the upright conduit; and opening means in the collar for passing a gas from the upright conduit into the pumping conduit.

13. A bubble-operated apparatus as defined in claim 11, in which the collar and the lower end of the pumping conduit form a self-supporting pumping structure in the bottom of the pot.

14. In a metal treating apparatus having a pot for holding a bath of molten metal having a metal line, bubble-operated apparatus for circulating the molten metal in the bath, comprising:

a pumping conduit having a molten metal inlet opening disposed beneath the metal line in the bath for receiving molten metal therein for upward motion along a path of motion;

the pumping conduit having a molten metal outlet opening for discharging molten metal received in the molten metal inlet opening, to a location beneath the metal line of the bath and above the inlet opening;

the pumping conduit having a plurality of gas-receiving openings below the molten metal outlet opening and above the molten metal inlet opening and around the path of motion of the molten metal in the conduit;

a gas delivery conduit connected to the pumping conduit for delivering gas to the plurality of gas-receiving openings;

the pumping conduit having an elongated midsection, the elongated midsection being disposed in a vertical position whereby the gas and the molten metal rise in a vertical direction as they move from the molten metal inlet opening to the molten metal outlet opening to induce a flow of molten metal from the molten metal inlet opening towards the molten metal outlet opening.

15. Apparatus as defined in claim 14, in which the gas is discharged from the plurality of gas-receiving openings in the direction of metal flow.

16. Apparatus as defined in claim 14, in which the pumping conduit has a horizontally elongated internal cross-section.

17. Apparatus as defined in claim 16, in which the pumping conduit has an internal elliptical cross-section.

18. Apparatus as defined in claim 14, in which the pumping conduit is elongated with a generally S-shaped configuration.

19. Apparatus as defined in claim 14, in which the pumping conduit has a bottom inlet opening for receiving a generally horizontal flow of molten metal, a vertical midsection, and a top outlet opening for discharging a generally horizontal flow of molten metal.

20. Apparatus as defined in claim 14, including means for introducing the gas intermittently to the pumping conduit to form a cascade of rising bubbles which entrap and raise sections of molten metal from the molten metal inlet opening.

21. Apparatus as defined in claim 14, including means for introducing the gas continuously to the pumping conduit to form a cascade of spaced rising bubbles which entrap and raise sections of molten metal from the molten metal inlet opening.

22. Apparatus as defined in claim 14, in which the pumping conduit and the first and second upright conduits are formed of a ceramic material.

23. In a metal treating apparatus having a pot for holding a bath of molten metal and a bubble-operated apparatus for circulating the molten metal in the bath having a metal line, comprising:

a metal lifting conduit having a molten metal inlet opening disposed beneath the metal line in the bath for receiving molten metal therein;

the metal lifting conduit having a molten metal outlet opening for discharging molten metal received in the inlet opening, to a location beneath the metal line of the bath and above the inlet opening;

the metal lifting conduit having a plurality of gas-receiving openings below the molten metal outlet opening and above the molten metal inlet opening;

a gas delivery conduit disposed adjacent the pumping conduit and connected to the plurality of gas-receiving openings;

the metal-lifting conduit having an elongated midsection with an internal generally elongated cross-section having a major horizontal dimension greater than the minor dimension; whereby the gas and the molten metal rise upwardly as they move from the inlet opening to the outlet opening having a major horizontal dimension greater than the minor dimension to induce a flow of molten metal from the molten metal inlet opening towards the molten metal outlet opening.

24. Apparatus as defined in claim 23, in which the gas is discharged into the direction of metal flow.

25. Apparatus as defined in claim 23, in which the metal-lifting conduit is elongated with a generally "S" shaped configuration.

26. Apparatus as defined in claim 23, in which the metal-lifting conduit has a bottom inlet opening for receiving a generally horizontal flow of molten metal, a vertical mid-section, and a top outlet opening for discharging a generally horizontal flow of molten metal.

27. Apparatus as defined in claim 23, including means for introducing the gas intermittently to the metal-lifting conduit to form a series of spaced, rising bubbles which entrap and raise sections of molten metal from the molten metal inlet opening.

28. Apparatus as defined in claim 23, including means for introducing the gas continuously to the metal-lifting conduit to form a series of spaced, rising bubbles which entrap and raise sections of molten metal from the molten metal inlet opening.

29. Apparatus as defined in claim 23, in which the metal-lifting conduit is formed of a ceramic material.

* * * * *